US008230619B2

(12) United States Patent
Salvatelli et al.

(10) Patent No.: US 8,230,619 B2
(45) Date of Patent: Jul. 31, 2012

(54) FOOTWEAR ORTHOSIS

(75) Inventors: Franco Salvatelli, Civitanova Marche (IT); Massimo Tulipani, Medrisio (CH)

(73) Assignee: Salvatelli SRL, Montegranaro (AP) (IT)

( * ) Notice: Subject to any disclaimer, the term of this patent is extended or adjusted under 35 U.S.C. 154(b) by 680 days.

(21) Appl. No.: 12/336,913

(22) Filed: Dec. 17, 2008

(65) Prior Publication Data

US 2009/0133292 A1 May 28, 2009

Related U.S. Application Data

(63) Continuation-in-part of application No. 11/124,026, filed on May 6, 2005, now abandoned.

(30) Foreign Application Priority Data

May 6, 2004 (IT) ..... MC2004A0063

(51) Int. Cl.
*A43B 13/38* (2006.01)
*A43B 7/14* (2006.01)
*A61F 5/00* (2006.01)

(52) U.S. Cl. ..... 36/88; 36/110; 36/71; 602/23; D2/961

(58) Field of Classification Search ..... 36/110, 36/114, 113, 88, 43, 44, 71; 602/23; D2/961
See application file for complete search history.

(56) References Cited

U.S. PATENT DOCUMENTS

| | | | | |
|---|---|---|---|---|
| 4,557,060 | A * | 12/1985 | Kawashima | 36/44 |
| 4,771,768 | A * | 9/1988 | Crispin | 602/16 |
| 5,088,481 | A * | 2/1992 | Darby | 602/23 |
| 5,287,210 | A * | 2/1994 | Sefidvash | 398/111 |
| 5,826,351 | A * | 10/1998 | Tsuji | 36/25 R |
| 6,453,578 | B1 * | 9/2002 | Yung et al. | 36/43 |
| 7,231,728 | B2 * | 6/2007 | Darby | 36/110 |
| D627,550 | S * | 11/2010 | Zhang | D2/961 |
| 2002/0178621 | A1 * | 12/2002 | Darby | 36/140 |

* cited by examiner

*Primary Examiner* — Jila Mohandesi
(74) *Attorney, Agent, or Firm* — Egbert Law Offices PLLC

(57) ABSTRACT

The present invention is an apparatus and method of orthopedic footwear for post-surgical or diabetic patients or for sanitary use. The footwear has an ambidextrous bottom sole. In a higher part thereof, there is a groove of at least 10 mm, in which an off-loading plantar insoles or medicine or bandages can be inserted. These have been built-in the bottom sole using an ortho-dynamic concept which allows the patient a controlled deambulation. To that end, the present invention prevents sheer force on the plantar part of the bottom sole and the foot and in particular on the metatarsal and/or tarsal part of the foot.

6 Claims, 5 Drawing Sheets

FOOTWEAR ORTHOSIS

CROSS-REFERENCE TO RELATED APPLICATIONS

The present application is a continuation-in-part of U.S. application Ser. No. 11/124,026, filed on 6 May 2005, entitled "Footwear Orthosis," presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention concerns orthopedic footwear for post-surgical or diabetic patients.

2. Description of Related Art

Including Information Disclosed Under 37 CFR 1.97 and 37 CFR 1.98.

In current technology, post-surgical or diabetic patients use orthopedic footwear with a modified bottom sole that makes the foot take a determined and forced inclination. Decompression is caused either only on the forefoot or only on the heel, avoiding contact of the injured part of the foot.

At this moment, post-surgical or diabetic patients use orthopedic footwear on the market which decompresses the forefoot or the heel of the patient with modifications on the front or back part of the bottom sole. A forced inclination is allowed to the foot in this way, obtaining the total absence of contact of the injured front or the back parts of the foot on the ground.

The bottom sole of this footwear is rigid and has a flat middle part, which has total contact with the ground. For three quarters thereof, the bottom sole is raised at the front or back part at an inclination of about 30 degrees.

The particular bottom sole of the above-mentioned orthopedic footwear presents the inconvenience of a difficult deambulation caused by the forced inclination of the patient's foot.

Furthermore, all of the orthopedic footwear for diabetics on the market at present, have a bottom sole with a completely flat part, which has total contact with the ground which provokes the drawback that the sheer force is concentrated in the corresponding plantar area.

A type of sole for orthopedic footwear, as described in U.S. Pat. No. 5,827,210 to Antar, is made up of a middle flat part bordered by a front part and a back part. The front part and back part are both convex towards the outer side in such a way to determine a rolling motion during the deambulation. This movement is caused by the total contact of the middle flat part of the bottom sole with the ground and by the action of the back part of the bottom sole which comes into contact with the ground by a heightened position to the ground underfoot like the front part.

The drawback of the Antar patent is that the middle flat part of the bottom sole having total contact with the surface underneath all the central plantar area is under a constant sheer force.

The aim of the present invention is to provide sanitary orthopedic footwear, for use by post-surgical or diabetic patients, produced using shock-absorbing and antibacterial material. There is a bottom sole, conceived on the orthodynamic concept and characterized by a ramp that allows cushioning of the shock during the landing phase of the foot, in such a way to determine a correct deambulation in the central phase of the march and a rotation in the take-off phase. This is made possible by the front and back parts of the bottom sole that are both convex and the part that has contact with the ground, that is only 8-12 mm long and on the Chopart line so as to have a constant instability of this bottom sole. This deliberate instability is necessary to avoid the concentration of the sheer force on the user's foot and in particular in the tarsal or metatarsal part.

Another aim of the present invention is to allow the use of sanitary orthopedic footwear in post-surgical or diabetic patient care, which can also be adapted to a highly-bandaged foot. The bottom sole of the present patent application, which is ambidextrous, includes two or more variations in four or more sides. The orthopedic footwear for post-surgical or diabetic patients can easily be used by patients who have different needs.

Another aim of the present invention is to provide sanitary orthopedic footwear for post-surgical or diabetic patients, characterized by a particular rigidity made possible by inserting a very rigid and crushproof insert in the inside of the bottom. This insert has a particular design and is made using antibacterial materials; it is washable and light.

Another aim of the present invention is to provide sanitary orthopedic footwear for post-surgical or diabetic patients characterized by a bottom sole having a groove in which bandages and/or medicines can be inserted. Two or more layers of particular plantar insole are characterized by modular and interchangeable elements, which can also be inserted. These allow localized sheer force reduction corresponding to diabetic foot ulcerations or plantar lesions.

These and other aims are achieved by the invention that is the subject of the present patent application relative to sanitary orthopedic footwear for post-surgical or diabetic patients in which the ambidextrous bottom sole is based on a orthodynamic concept, including a groove of at least 10 mm in depth. The off-loading plantar insole and/or medicine can be inserted in the groove. Each of the front and back parts of the bottom sole are convex. The only contact point with the surface underneath is on the Chopart line and is limited to 8-12 mm. For these reasons, during the deambulation the bottom sole is not, at any time, completely and continuously in contact with the surface underneath. This determines its constant, in this way avoiding sheer force on the patient's foot and in particular in the metatarsal, tarsal and central parts.

BRIEF SUMMARY OF THE INVENTION

The present invention has an ambidextrous bottom sole. In a higher part thereof, there is a groove of at least 10 mm of depth, in which off-loading plantar insoles or medicine or bandages can be inserted. These have been built-in using an ortho-dynamic concept which allows the patient a controlled deambulation and to that end, to avoid sheer force on the plantar part of the foot and in particular on the metatarsal and/or tarsal part.

To avoid the above-mentioned drawbacks of the prior art, the bottom sole of the orthopedic footwear, which is the subject of the present patent, has only a single point of contact, being only a few millimeters long (8-12 mm) with the surface underneath. It has a highly defined convexity at the front and the back. Furthermore the point of contact with the ground in the static phase has been deliberately placed in correspondence to the Chopart line of the foot.

The Chopart line is the defined neutral line that separates the anklebone scaphoid and the heel cuboid joints, statistical studies have shown the lowest possibility of diabetic plantar lesions on this line.

BRIEF DESCRIPTION OF THE SEVERAL VIEWS OF THE DRAWINGS

Other characteristics and advantages of the invention will result from a form of implementation of the present invention, preferred but not exclusively sanitary orthopedic footwear for post-surgical or diabetic patients in medical use. The present patent application is illustrated approximately in the drawings.

DETAILED DESCRIPTION OF THE INVENTION

Figure 1:
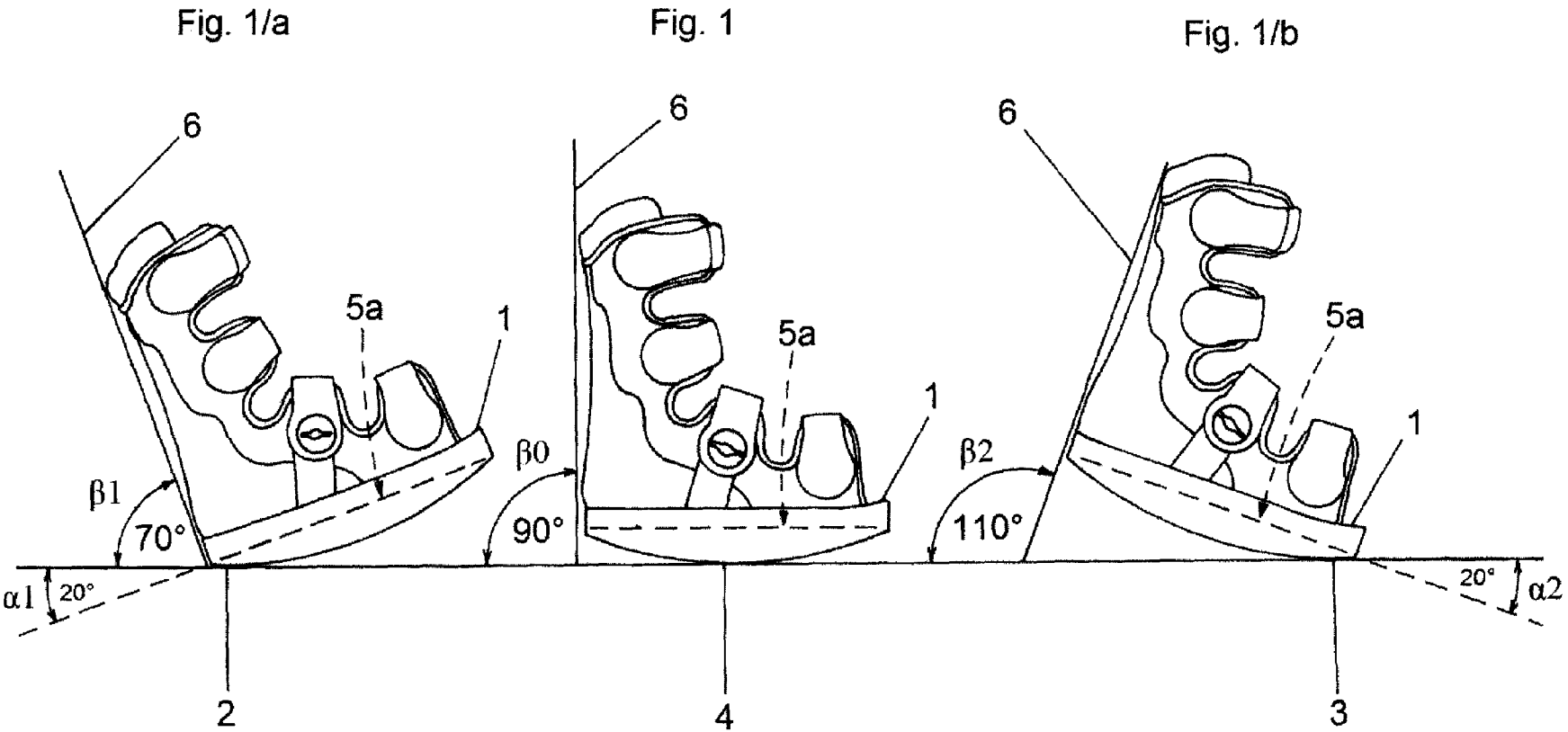
FIGS. 1, 1/*a*, and 1/*b* are side elevation views of the bottom sole in the three positions from the deambulation phase of the sanitary orthopedic footwear for post-surgical or diabetic patients.

The rigidity of the bottom sole 1 is obtained by an element called a "rigid insert 5", which is inserted into the bottom sole 1 in an opposite groove 10, having a function of avoiding flexing and torsion in the entire plantar area of the foot, both in a static or dynamic phase. The groove having a depth (D) of at least 10 mm. This rigid insert 5 is extremely resistant to repeated flexes, moulded with a very rigid, light, uncrushable, antibacterial and washable material. The molds are the exclusive property of the company that is presenting this patent application. This rigid insert 5 is characterized by a particular rigidity, lightness and uncrushability, and it has a completely flat structure 5*a* on the upper part which is in contact with the foot and lower structure 5*b* that follows the lines of the bottom sole 1 to which it is attached. This is to ensure that the foot rests on a completely flat surface without modifying the deambulation created by the deambulation ramp of the bottom of the present patent application.

Orthopedic footwear for diabetic patients must allow the total decompression of the patient's foot where the diabetic plantar ulceration is present. To achieve this result, the diabetic footwear that has a bottom sole 1 that has the shape and characteristics as described above, offering the possibility to insert a series of three multi-level, washable off-loading plantar insole 7*a*, 7*b*, 7*c* with different mechanical and shock-absorbent characteristics for each layer in the groove 10 of the sole bottom. Each of these plantar insoles is characterized by three modular and exchangeable systems 8*a*, 8*b*, 8*c*, being used to change hardness and softness in such a way to guarantee the total off-load of the injured part of the foot according to the patient's needs.

All of the orthopedic footwear has uses for either diabetic patients or sanitary use, being available on the market at present and being removable by the patients themselves.

As many scientific studies have demonstrated that irremovable off-loading devices for diabetic foot lesions shorten considerably the healing time of lesions, by reducing patient's non-compliance during the treatment, the present invention includes a non-removable system which consists of the application of inserts for the passage of disposable self-blocking strips that, once sealed, do not allow patient to reopen the footwear and remove it.

Non-removable system consists of two inserts of flexible semi-rigid material with a eyelet in the middle, anchored at the external upper sides of the upper. These inserts allow the insertion of a plastic strip with disposable pressure fastening system (of the kind commonly available on market) which is provided with the device.

This kind of strip in soft and flexible material passes through the holes of the two lateral inserts and, once closed on its opposite extremity, the device will be blocked at the minimum height of the ankle or at the maximum height of the shin-calf and it cannot longer be reopened or removed if not by cutting it by means of proper cutting tool.

Non-removable systems allow a physician to fix the sanitary orthopedic footwear for diabetic patients or sanitary use to the patient's foot. The non-compliant patient could remove the orthopedic footwear from his/her foot independently. The bottom sole 1 comprises a lower surface having a back portion 2, a front portion 3 and a central portion 4 disposed in correspondence with the Chopart line between the back portion 2 and the front portion 3.

In FIGS. 1, 1adjacent and 1body 74, the bottom sole 1 is shown with a deambulation ramp an inclination of with an underlying surface with an angle $\beta 1$ of when the foot lands on the back part (2) (FIG. 1adjacent) and an angle of $\beta 2$ of 110° in the taking off phase the front part (3) (FIG. 1body 74). In the static phase, the the central portion 4 is in contact with ground and the deambulation ramp 6 has an inclination of an angle $\beta 0$ of 90° with respect to the underlying surface (FIG. 1). The bottom sole (1) is characterized by the fact that in the deambulation phase inclination of the deambulation ramp with respect to the underlying surface goes from 70° of the back part (2) to an inclination of 90° in the central part (4) which increases up to 110° at the front part (3).

Furthermore, the front portion 3 and the back portion 2 are both convex and have the same convexity. The convexity of the back portion of the bottom sole is such that the back portion can roll on the underlying surface until the planar upper surface 5*a* of the rigid surface is inclined at an angle $\alpha 1$ of 20° with respect to the underlying surface. The convexity of the front portion 3 of the bottom sole is such that the front portion 3 can roll on the underlying surface until the planar upper surface 5*a* of the rigid inert is inclined at an angle $\alpha 1$ of 20° with respect to the underlying surface. The central portion 4 is on the Chopart line 6 and has a length L of 8 to 12 millimeters. These characteristics ensure that the bottom sole is never completely and continuously in contact with the underlying surface so as to cause a constant imbalance of the contact point the bottom sole ensure that the concentration of shear force is not present on the patient's foot, especially on the tarsal, metatarsal and central parts of the foot.

Figure 2:
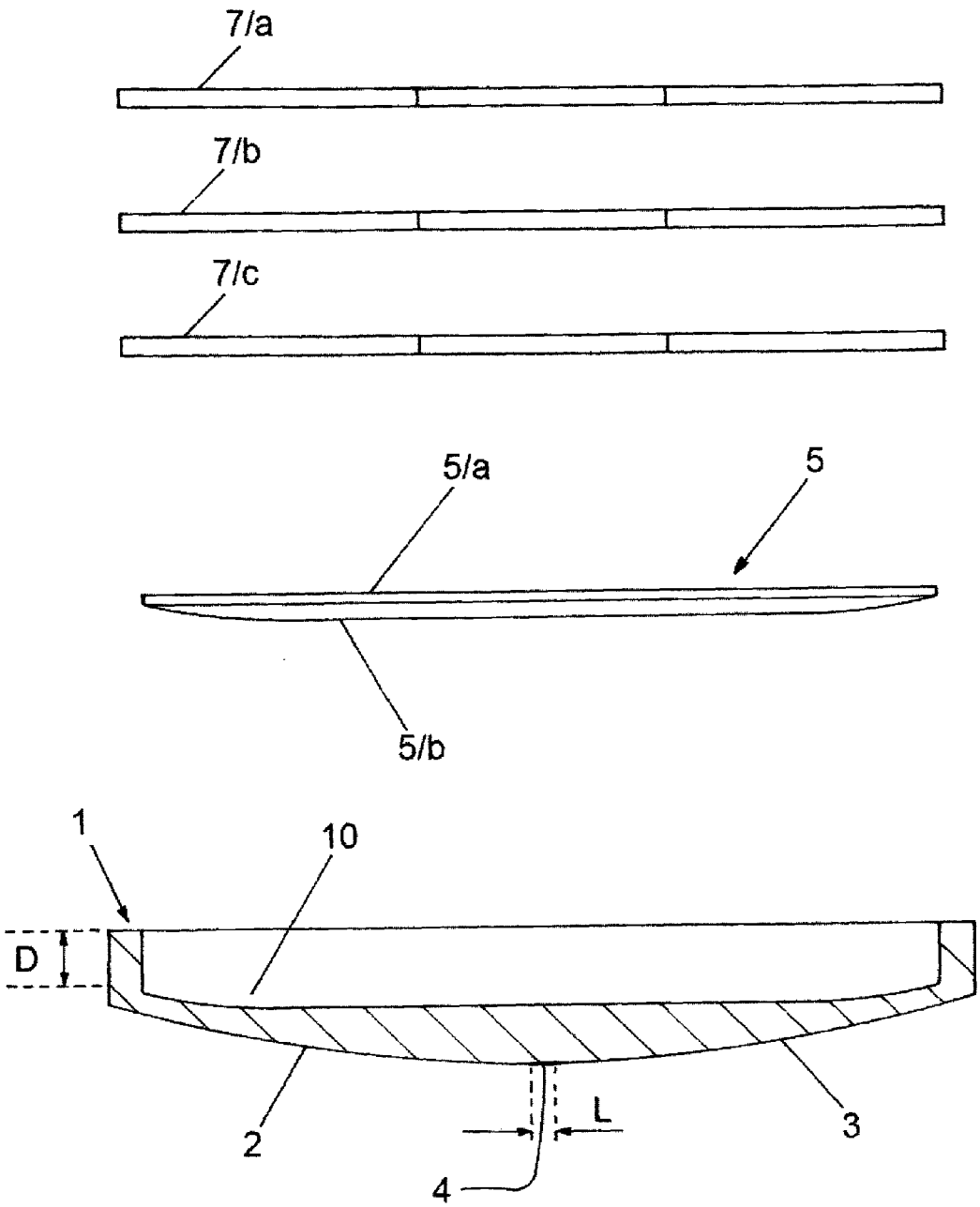
FIG. 2 is an exploded elevation view of the bottom sole of the footwear of the present patent application, showing a section of the bottom sole, the rigid insert insert and the three-plantar insole system that are removed from the bottom sole.

To achieve this result, it is also necessary that the bottom sole (1) is rigid to avoid its flexions and torsions. The rigid insert (5) is inserted into the bottom sole groove 10. The rigid insert (5) also shown in FIG. 2, is made with antibacterial, washable material and is characterized by a high resistance to repeated flexions, lightness and its uncrushability. This rigid insert (5) is characterized by a structure that permits the flat higher surface 5adjacent that has contact with the foot and the lower surface 5body 74 that follows the shape of the bottom sole to which it is attached. In such a way, it does not alter the deambulation created by the ramp of the bottom sole.

Another component of the bottom sole of the above mentioned type of orthopedic footwear is the series of two or more multilayer plantar insoles (7/*a*), (7/*b*), (7/*c*) in FIG. 2, with mechanical and shock-absorbent characteristics with different characteristics and that are produced using washable and disinfectable materials.

Figure 3:
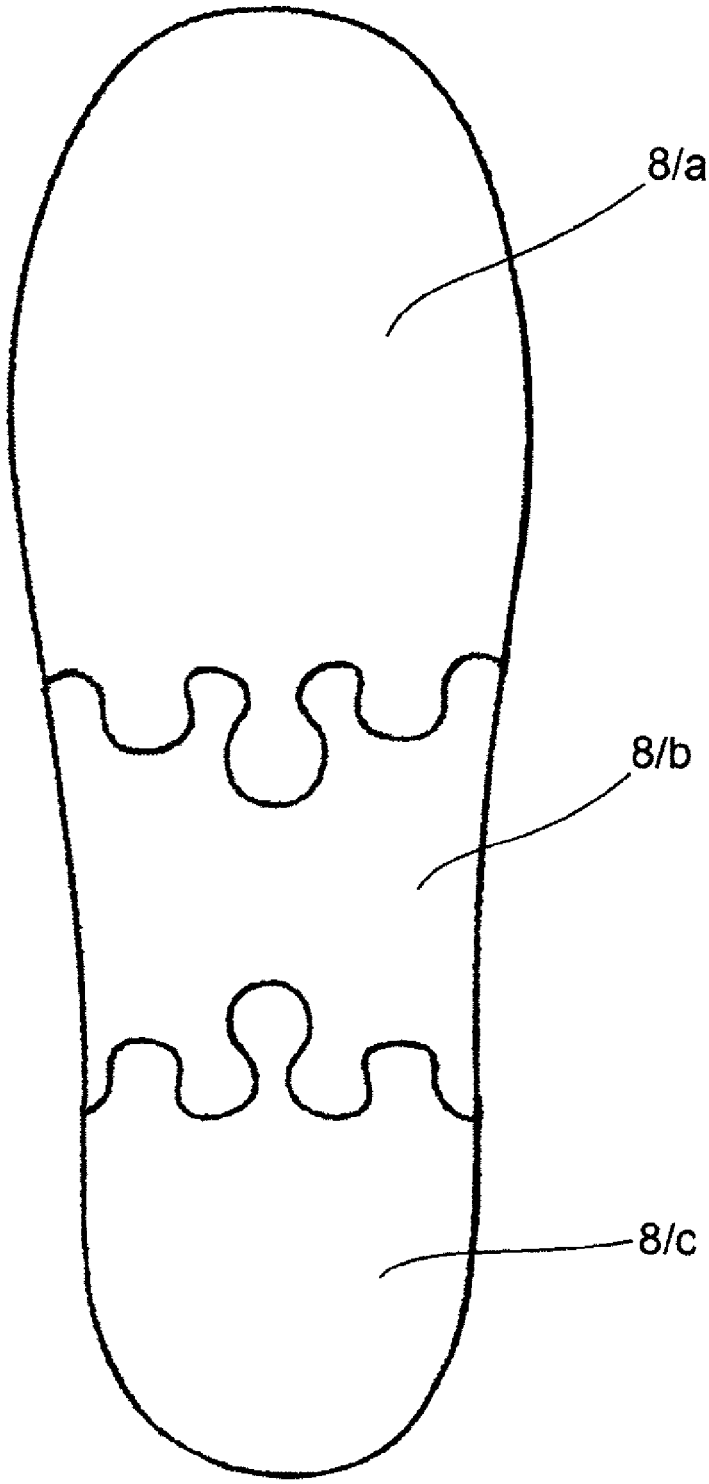
FIG. 3 is a top plan view of one of the three modular and interchangeable plantar insoles that make up the plantar insole system.

FIG. 3 is a view one of the two or more plantar insoles described in the previous paragraph seen from above, each of which is made up of two or three modular elements and which are interchangeable between the three pieces. The forefoot (8/*a*) is represented as a part thereof. The central plantar insole (8/*b*) is another part, and back part (8/*c*) is represented by the back part of the plantar insole.

This series of two or more modular plantar insoles (7/*a*), (7/*b*) and (7/*c*), each of which is made up of one element with three modular and interchangeable elements (8/*a*), (8/*b*) and (8/*c*) makes it possible to alter the hardness and elasticity according the patients' needs and to guarantee the total off-load of the diabetic foot ulceration or plantar lesions.

Figure 4:
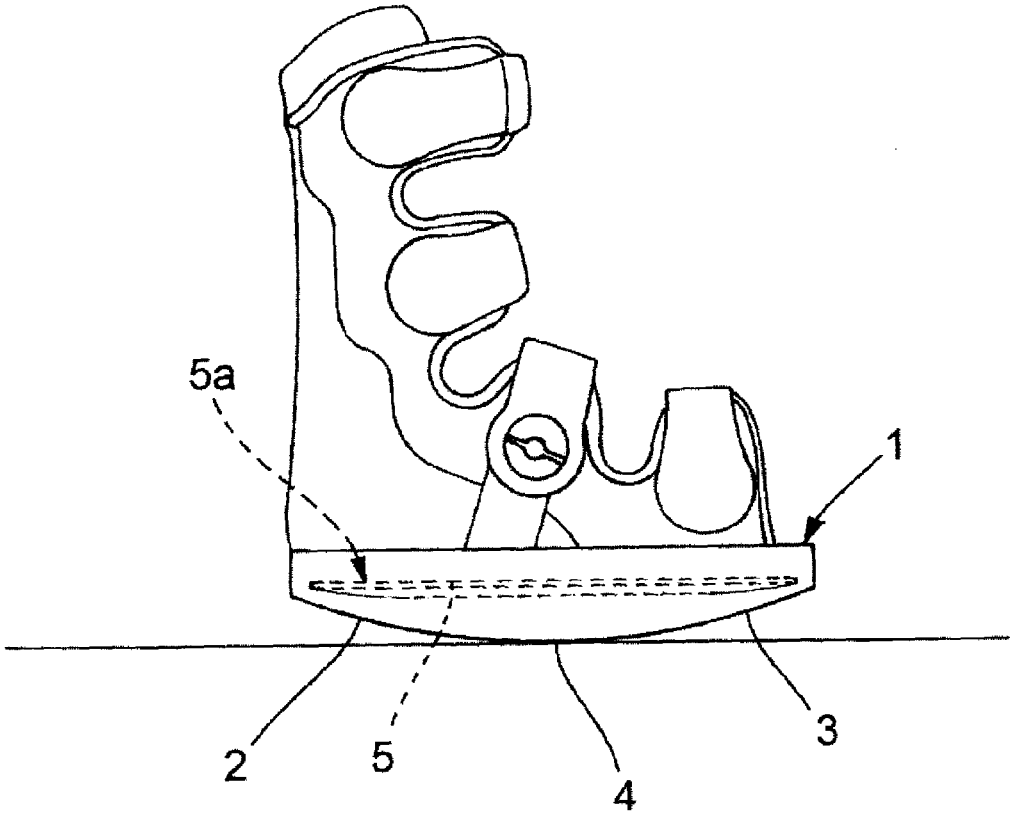
FIG. 4 is another side elevation view of the orthopedic footwear of the present invention.
Figure 5:
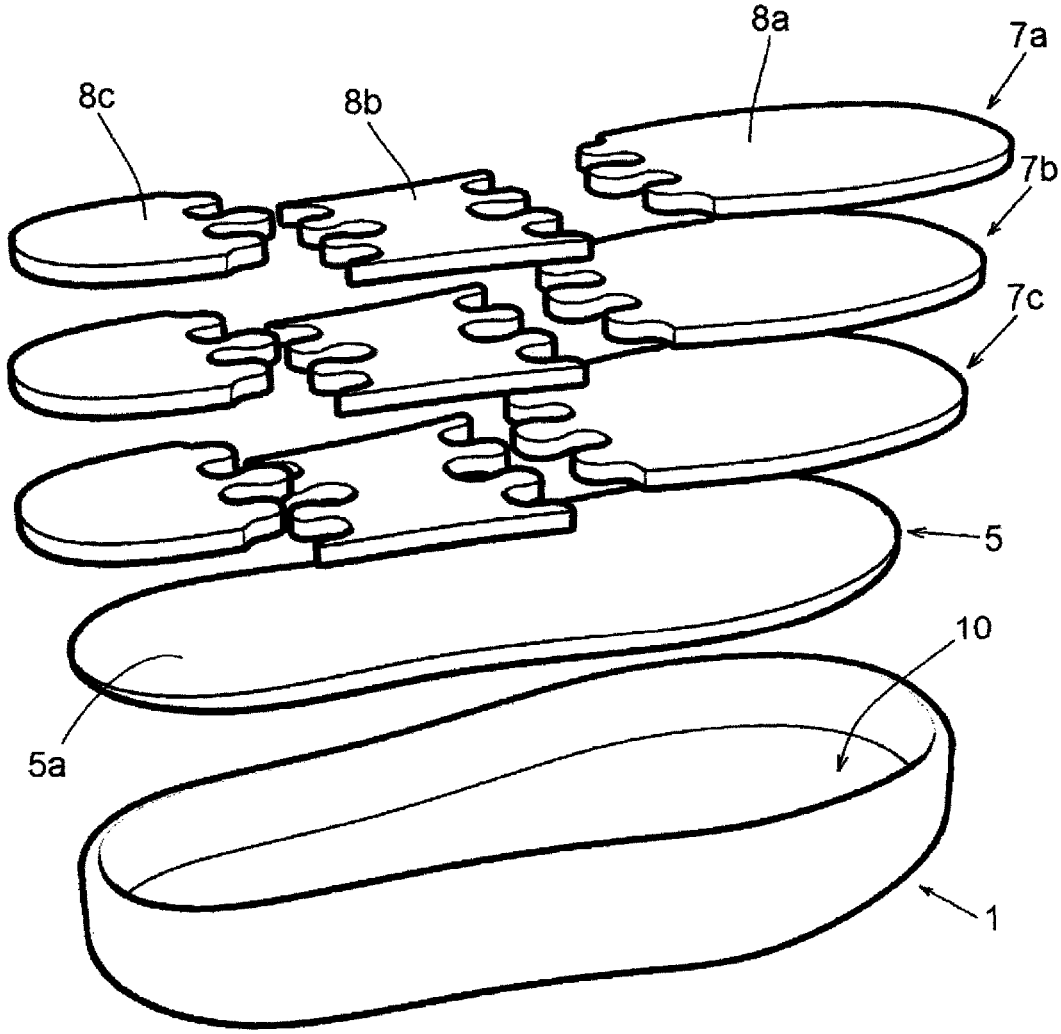
FIG. 5 is an exploded perspective view shoeing the bottom sole, the rigid insert, and the three-plantar insole system.

The bottom sole that is the subject of this patent application is furthermore characterized by a ambidextrous shape that allows us to create post-surgical footwear that can be used either by diabetic patients or for sanitary use in two or more variations and in four or more lengths and so it can be easily used according to the various needs of the patients FIG. 4 shows the elevation view of the footwear again, at the front and back parts of the bottom sole, being convex and with the central portion limited to 8-12 mm.

The invention thus conceived can be subjected to many modifications and variants, all of these enter the sphere of the invented concept, furthermore the materials and sizes of the above mentioned invention, illustrated in the accompanying designs and later laid claim to, can be made according to the needs.

We claim:

1. An orthopedic footwear article comprising:

an ambidextrous bottom sole having a groove formed in an upper portion thereof, said groove having a depth of at least 10 millimeters, said bottom sole having a bottom surface having a back portion and a front portion and a central portion disposed in relation to a Chopart line of the foot, said central portion disposed between said front portion and said rear portion, said central portion being the only portion contacting an underlying surface when said bottom sole is in a static position;

a rigid insert received in said groove of said bottom sole, said rigid insert having an entirely planar upper surface; and an insole disposed on said rigid insert and housed in said groove of said bottom sole, said insole being a shock-absorbing material, said front portion and said back portion of said bottom sole having a convex shape, said central portion of said bottom sole being planar and having a length of between 8 and 12 millimeters from said back portion to said front portion, said planar upper surface of said rigid insert extending for an entire plantar area of the foot.

2. The orthopedic footwear article of claim 1, said planar upper surface of said rigid insert being in parallel planar relationship to said central portion of said bottom sole, said convex shape of said back portion having a convexity such that said planar upper surface of said rigid insert is at an angle of 20° with respect to the underlying surface when said back portion contacts the underlying surface, said convex shape of said front portion having a convexity such that said planar supper surface of said rigid insert is at an angle of 20° with respect to the underlying surface when said front portion contacts through underlying surface.

3. The orthopedic footwear article of claim 2, said bottom sole having a deambulation ramp extending along a line orthogonal to said planar upper surface of said rigid insert, said deambulation ramp extending at a 70° angle with respect to the underlying surface and extending at a 90° angle with respect to the underlying surface when said central portion contacts the underlying surface and extending at a 110° angle with respect to the underlying surface when said front portion contacts the underlying surface.

4. The orthopedic footwear article of claim 1, said insole comprising:

a first element suitable for corresponding to a forefoot of the foot;

a second element suitable for corresponding to a central part of the foot; and a third element suitable for correspondence with a heel of the foot, said first element and said second element and said third element being modular and interchangeable.

5. The orthopedic footwear article of claim 1, said insole comprising at least two insoles arranged in a layered configuration.

6. The orthopedic footwear article of claim 5, said insole comprising three insoles that are modular and interchangeable, each of said three insoles comprising:

a first element suitable for corresponding to a forefoot of the foot;

a second element suitable for corresponding to a central part of the foot; and a third element suitable for correspondence with a heel of the foot, said first element and said second element and said third element being modular and interchangeable.

* * * * *